US009804547B2

(12) United States Patent
Yamagishi et al.

(10) Patent No.: US 9,804,547 B2
(45) Date of Patent: Oct. 31, 2017

(54) FIXING DEVICE AND IMAGE FORMING APPARATUS THAT REDUCE ROTATION FAILURE OF FIXING BELT

(71) Applicant: KYOCERA Document Solutions Inc., Osaka (JP)

(72) Inventors: Yoshihiro Yamagishi, Osaka (JP); Kotatsu Kawaguchi, Osaka (JP); Takashi Eiki, Osaka (JP); Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/265,525

(22) Filed: Sep. 14, 2016

(65) Prior Publication Data

US 2017/0102655 A1 Apr. 13, 2017

(30) Foreign Application Priority Data

Oct. 7, 2015 (JP) ..... 2015-199303

(51) Int. Cl.
*G03G 15/20* (2006.01)

(52) U.S. Cl.
CPC ..... *G03G 15/2089* (2013.01)

(58) Field of Classification Search
None
See application file for complete search history.

(56) References Cited

U.S. PATENT DOCUMENTS

2003/0156866 A1* 8/2003 Shida ..... H05B 6/145 399/328
2013/0330111 A1* 12/2013 Tokuda ..... G03G 15/6576 399/329
2014/0241768 A1* 8/2014 Egi ..... G03G 15/2017 399/329

FOREIGN PATENT DOCUMENTS

JP 2007-171749 A 7/2007

* cited by examiner

*Primary Examiner* — Thomas Giampaolo, II
(74) *Attorney, Agent, or Firm* — Stein IP, LLC

(57) ABSTRACT

A fixing device includes a fixing belt rotatably located around a rotation axis, a pressure member rotatably located, and a pressing member. The pressure member is brought into pressure contact with the fixing belt to form a fixing nip. The pressing member includes a pressing surface that presses the fixing belt toward a side of the pressure member. The pressing surface includes a plane surface portion extending along a conveyance direction of a recording medium, and a curved surface portion located at a downstream side of the plane surface portion in the conveyance direction of the recording medium. The curved surface portion is curved along an outer peripheral surface of the pressure member. The curved surface portion has a curvature radius larger than a curvature radius of the outer peripheral surface of the pressure member before a deformation in association with a formation of the fixing nip.

5 Claims, 5 Drawing Sheets

FIXING DEVICE AND IMAGE FORMING APPARATUS THAT REDUCE ROTATION FAILURE OF FIXING BELT

INCORPORATION BY REFERENCE

This application is based upon, and claims the benefit of priority from, corresponding Japanese Patent Application No. 2015-199303 filed in the Japan Patent Office on Oct. 7, 2015, the entire contents of which are incorporated herein by reference.

BACKGROUND

Unless otherwise indicated herein, the description in this section is not prior art to the claims in this application and is not admitted to be prior art by inclusion in this section.

A typical image forming apparatus employing an electrophotographic method, such as a copier and a printer, includes a typical fixing device that fixes a toner image on a recording medium, such as a paper sheet.

For example, there is known a fixing device including a fixing belt, a pressure member, and a pressing member. The pressure member is brought into pressure contact with a fixing belt to form a fixing nip. The pressing member presses the fixing belt toward the pressure-member side. The above-described pressing member includes a plane surface portion and a curved surface portion. The plane surface portion extends along a conveyance direction of a recording medium. The curved surface portion is located in a downstream side of the plane surface portion in the conveyance direction of the recording medium.

SUMMARY

A fixing device includes a fixing belt, a pressure member, and a pressing member. The fixing belt is rotatably located around a rotation axis. The pressure member is in pressure contact with the fixing belt to form a fixing nip and is rotatably located. The pressing member includes a pressing surface that presses the fixing belt toward a side of the pressure member. The pressing surface includes a plane surface portion and a curved surface portion. The plane surface portion extends along a conveyance direction of a recording medium. The curved surface portion is located at a downstream side of the plane surface portion in the conveyance direction of the recording medium and is curved along an outer peripheral surface of the pressure member. The curved surface portion has a curvature radius larger than a curvature radius of the outer peripheral surface of the pressure member before a deformation in association with a formation of the fixing nip.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
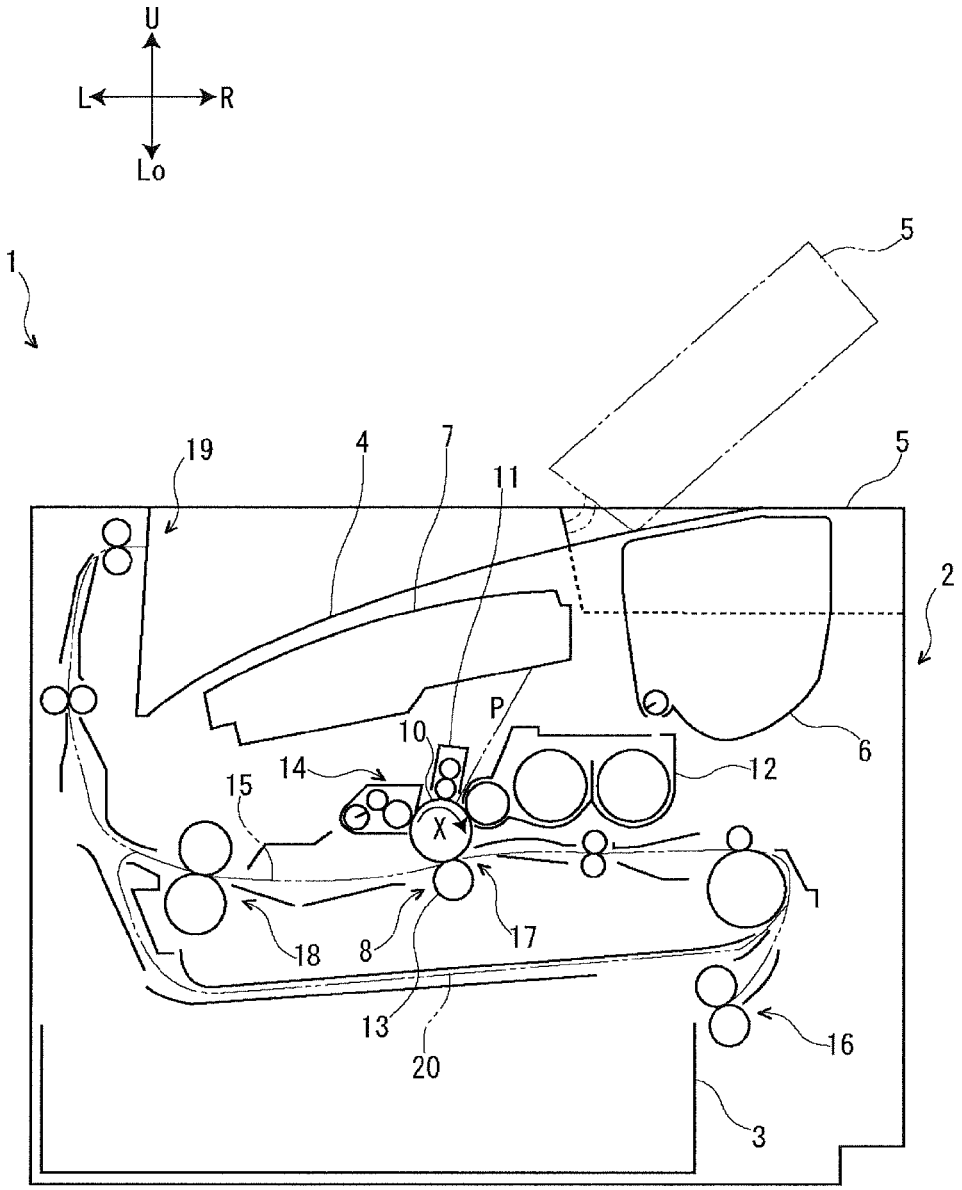
FIG. 1 schematically illustrates an outline of a printer according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

First, using FIG. 1, the following describes an overall configuration of a printer 1 (which is an image forming apparatus). Hereinafter, a paper-surface-front side in FIG. 1 is defined as a front side of the printer 1. Arrows Fr, Rr, L, R, U, and Lo appropriately attached in respective drawings indicate a front side, a rear side, a left side, a right side, an upper side, and a lower side of the printer 1, respectively.

The printer 1 includes a printer main body 2 with a box shape. In a lower portion of the printer main body 2, a sheet feed cassette 3, which houses paper sheets (recording media), is housed. The printer main body 2 has a top surface on which a sheet discharge tray 4 is located. The printer main body 2 has a top surface on which an upper cover 5 is openably/closably mounted on a side portion of the sheet discharge tray 4. Below the upper cover 5, a toner container 6 is housed.

The printer main body 2 has an upper portion in which an exposure device 7 constituted of a laser scanning unit (LSU) is located below the sheet discharge tray 4. Below the exposure device 7, an image forming unit 8 is located. The image forming unit 8 includes a rotatably-located-photoreceptor drum 10 as an image carrier. The photoreceptor drum 10 has a peripheral area on which a charger 11, a developing unit 12, a transfer roller 13, and a cleaning apparatus 14 are located along a rotation direction of the photoreceptor drum 10 (see an arrow X illustrated in FIG. 1).

The printer main body 2 internally includes a conveying path 15 for the paper sheets. The conveying path 15 has an upstream end on which a paper sheet feeder 16 is located, and has a midstream portion in which a transfer unit 17 constituted of the photoreceptor drum 10 and the transfer roller 13 is located. The conveying path 15 further has a downstream portion in which a fixing device 18 is located, and has a downstream end in which a paper sheet discharge unit 19 is located. Below the conveying path 15, an inversion path 20 for duplex printing is formed.

Next, the following describes an image forming operation of the thus configured printer 1.

Turning on the power supply of the printer 1 initializes various kinds of parameters and executes an initial setting, such as a temperature setting of the fixing device 18. Then, image data is input from, for example, a computer connected to the printer 1, and a print start is instructed, which causes an execution of the image forming operation as follows.

First, after the charger 11 charges a surface of the photoreceptor drum 10, a laser beam (see a two-dot chain line P illustrated in FIG. 1) from the exposure device 7 performs an exposure corresponding to the image data on the photoreceptor drum 10 to form an electrostatic latent image on the surface of the photoreceptor drum 10. Subsequently, this electrostatic latent image is developed to form a toner image with a toner by the developing unit 12.

On the other hand, the paper sheet taken out from the sheet feed cassette 3 by the paper sheet feeder 16 is conveyed to the transfer unit 17 at a timing synchronized with a timing of the above-described image forming operation, and then the transfer unit 17 transfers the toner image on the photoreceptor drum 10 onto the paper sheet. After the paper sheet on which the toner image is transferred is conveyed to a downstream side of the conveying path 15, and is conveyed into the fixing device 18, the toner image is fixed on the paper sheet by this fixing device 18. The paper sheet on which the toner image is fixed is discharged to the sheet discharge tray 4 from the paper sheet discharge unit 19. The toner remaining on the photoreceptor drum 10 is recovered by the cleaning apparatus 14.

Next, using FIGS. 2 to 5, the following describes the fixing device 18 in detail. Arrows Y appropriately attached in the respective drawings indicate conveyance directions of the paper sheet. Arrows I attached in FIGS. 3 to 5 indicate an inside of a front-rear direction, and arrows O attached in FIGS. 3 to 5 indicate an outside of the front-rear direction.

Figure 2:
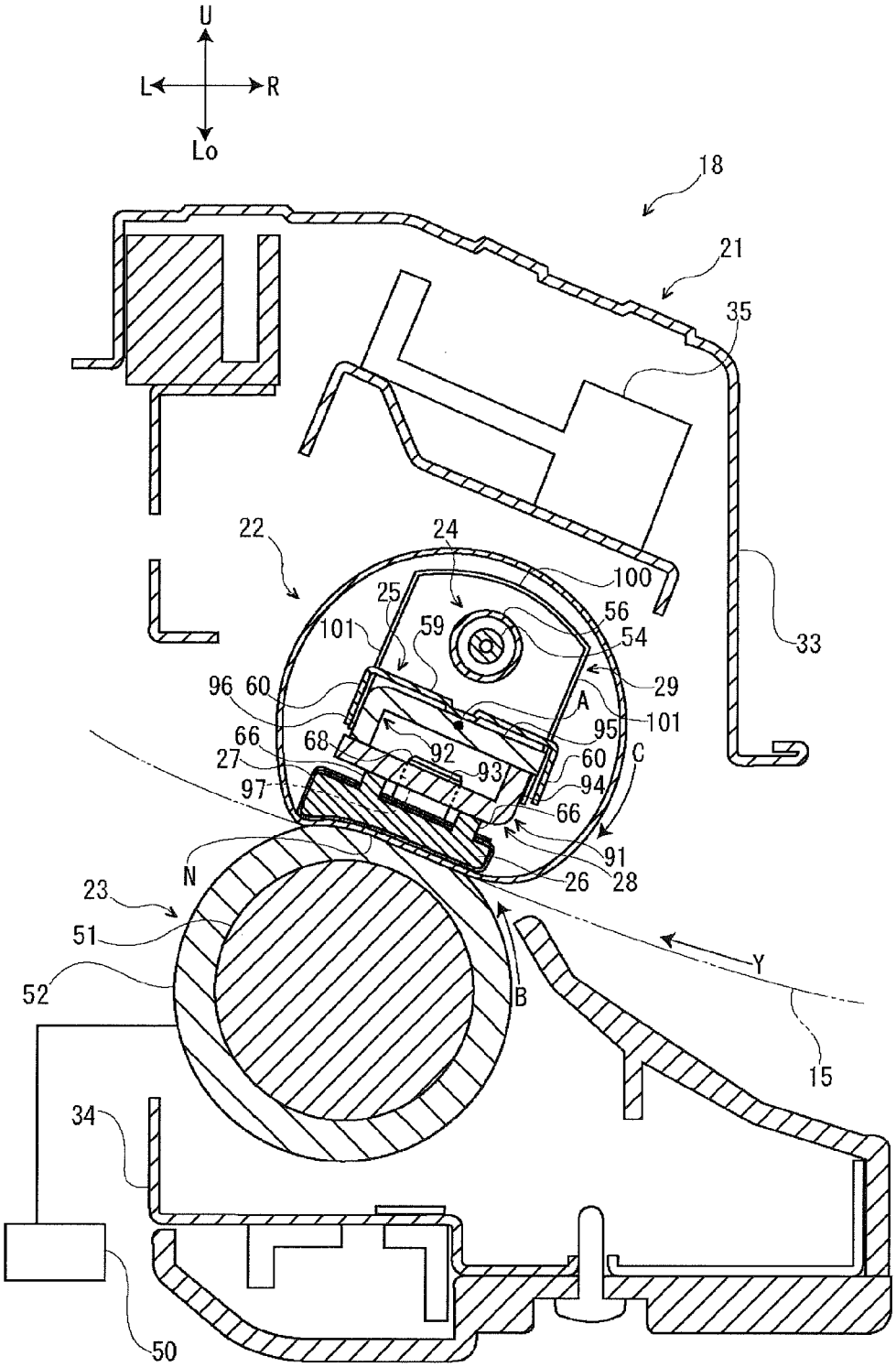
FIG. 2 illustrates a cross section of a fixing device according to the one embodiment.
Figure 3:
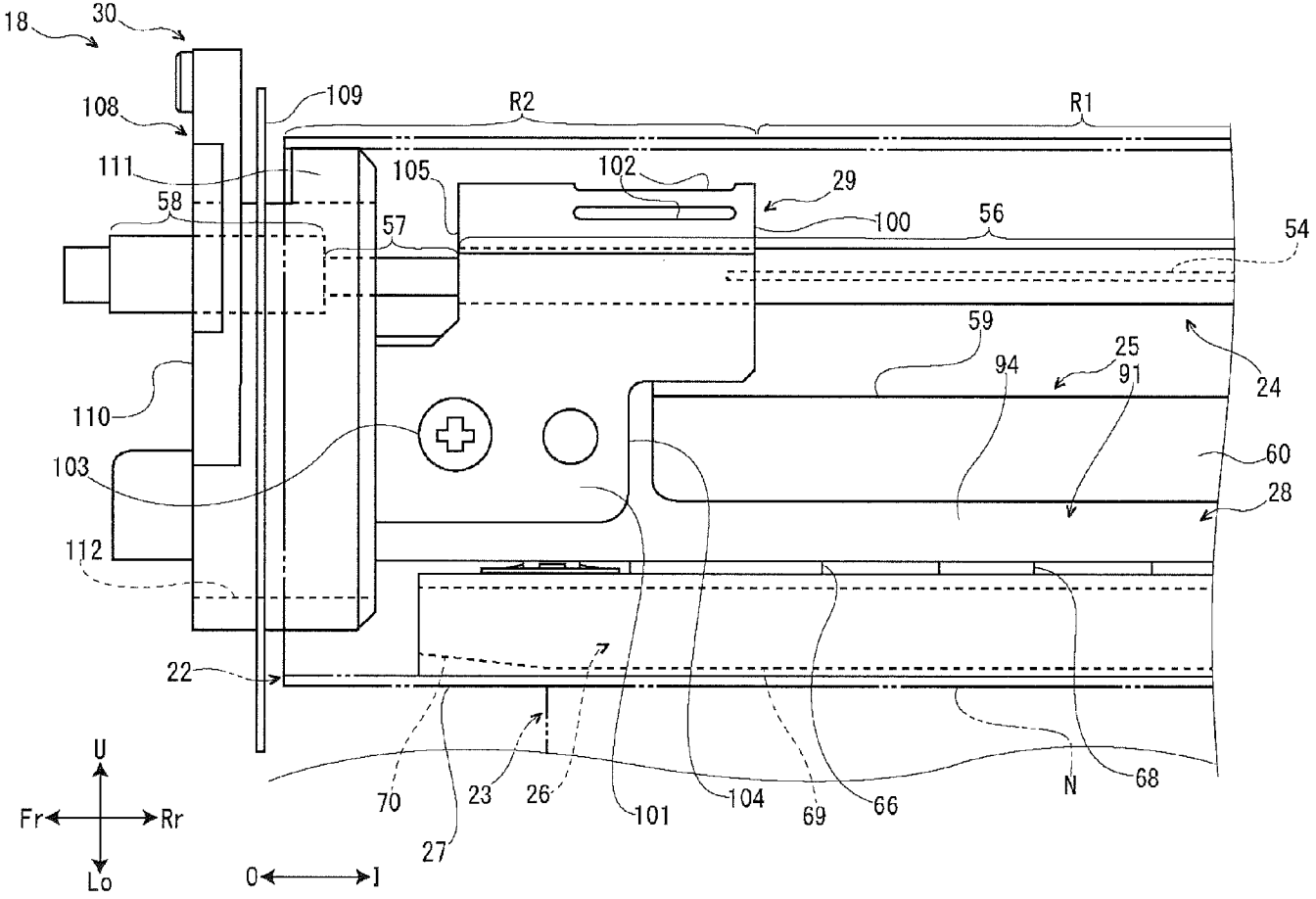
FIG. 3 obliquely illustrates a front portion of the fixing device according to the one embodiment from a slightly lower side with respect to just beside the fixing device.

As illustrated in FIGS. 2 and 3, the fixing device 18 includes a fixing frame 21 (not illustrated in FIG. 3), a fixing belt 22, a pressure roller 23 (a pressure member), a heater 24 (a heat source), a reflecting member 25, a pressing pad 26 (a pressing member), a sheet member 27, a supporting member 28, cover members 29, and regulating members 30 (not illustrated in FIG. 2). The fixing frame 21 has a box shape. The fixing belt 22 is housed in an upper portion of the fixing frame 21. The pressure roller 23 is housed in a lower portion of the fixing frame 21 and is located at a lower side (an outer diameter side) of the fixing belt 22. The heater 24 is located above a space of an inner diameter side of the fixing belt 22. The reflecting member 25 is at a lower side of the heater 24 in the space of the inner diameter side of the fixing belt 22. The pressing pad 26 is located at a lower end portion in the space of the inner diameter side of the fixing belt 22. The sheet member 27 is wound around the pressing pad 26. The supporting member 28 is located at an upper side of the pressing pad 26 in the space of the inner diameter side of the fixing belt 22. The cover members 29 are located between the fixing belt 22 and the heater 24. The regulating members 30 are mounted at both front and rear end portions of the fixing belt 22.

As illustrated in FIG. 2, the fixing frame 21 is constituted of an upper frame portion 33 and a lower frame portion 34. The upper frame portion 33 includes a thermal cutoff 35 (an overheating preventing unit) for preventing the fixing belt 22 from overheating.

The fixing belt 22 has an approximately-cylindrical shape and is long in the front-rear direction. The fixing belt 22 is rotatably located around a rotation axis A extending in the front-rear direction. That is, in the embodiment, the front-rear direction is a rotation-axis direction of the fixing belt 22.

The fixing belt 22 has flexibility and is endless in a circumferential direction. The fixing belt 22 includes, for example, a base material layer, an elastic layer circularly located around this base material layer, and a release layer coating this elastic layer. The base material layer of the fixing belt 22 is made of metal, such as SUS, or similar metal. The base material layer of the fixing belt 22 may be made of resin, such as polyimide (PI) or similar resin. The base material layer of the fixing belt 22 has an inner circumference surface on which a fluorine-based resin coating is performed. The elastic layer of the fixing belt 22 is made of, for example, a silicon rubber with a thickness of 270 μm. The release layer of the fixing belt 22 is made of, for example, a PFA tube with a thickness of 20 μm.

As illustrated in FIG. 3, the fixing belt 22 includes a passing area R1 and non-passing areas R2 each located on both front and rear outsides of the passing area R1. The passing area R1 is an area through which a paper sheet with the largest size (for example, an A3-size paper sheet) is passed, and the non-passing areas R2 are areas through which the paper sheet with the largest size is not passed.

As illustrated in FIG. 2, the pressure roller 23 has an approximately-columnar shape and is long in the front-rear direction. The pressure roller 23 is brought into pressure contact with the fixing belt 22, causing a fixing nip N to be formed between the fixing belt 22 and the pressure roller 23. A diameter of the pressure roller 23 before a deformation in association with a formation of the fixing nip N (a diameter of the pressure roller 23 when a cross section has a true circle shape) is 30 mm. A curvature radius of an outer peripheral surface of the pressure roller 23 before the deformation in association with the formation of the fixing nip N (a curvature radius of the outer peripheral surface of the pressure roller 23 when the cross section has the true circle shape) is 15 mm. The pressure roller 23 is connected to a driving source 50 constituted of a motor and similar part and is configured to be rotated by the driving source 50. The pressure roller 23 includes, for example, a column-shaped core material 51, an elastic layer 52 circularly disposed around this core material 51, and a release layer (not illustrated) coating this elastic layer 52. The pressure roller 23 has the core material 51 made of metal, such as iron or similar metal. The pressure roller 23 has the elastic layer 52 made of, for example, a silicon rubber with a thickness of 3.5 mm. The pressure roller 23 has the release layer made of, for example, a PFA tube.

The heater 24 is constituted of, for example, a halogen heater. The heater 24 has a long shape in the front-rear direction. The heater 24 is located at a position biased toward an upper side (a side spaced apart from the pressure roller 23) with respect to the rotation axis A of the fixing belt 22.

As illustrated in FIG. 3, the heater 24 includes a filament 54 (a heat radiating portion), a housing portion 56, sealing portions 57, and held portions 58. The housing portion 56 houses both the filament 54 and a halogen gas. The sealing portions 57 are each located on both front and rear outsides of the housing portion 56. The held portions 58 are each located on both front and rear outsides of the sealing portions 57. The filament 54 is made of, for example, tungsten and has a coiled shape. The filament 54 is configured to heat in association with an energization of the heater 24 to radiate radiation heat. The housing portion 56 is made of, for example, quartz glass. The respective sealing portions 57 each seal both front and rear end portions of the housing portion 56. The respective held portions 58 are held by the fixing frame 21 or the supporting member 28.

As illustrated in FIG. 2, the reflecting member 25 has an approximately-U-shaped cross section with a convex toward the upper side (the side spaced apart from the pressure roller 23). The reflecting member 25 has a long shape in the front-rear direction. The reflecting member 25 is made of, for example, metal, such as bright aluminum. The reflecting member 25 is located between the heater 24 and the supporting member 28.

The reflecting member 25 includes a reflecting plate portion 59 and guide plate portions 60. The reflecting plate portion 59 is located along the conveyance direction of the paper sheet. The guide plate portions 60 are bent downward from both right and left end portions of the reflecting plate portion 59 (end portions of upstream and downstream sides in the conveyance direction of the paper sheet). The reflecting plate portion 59 has the top surface opposed to the heater 24.

As illustrated in FIGS. 2 and 3, the pressing pad 26 has a flat-plate shape and is long in the front-rear direction. That is, in the embodiment, the front-rear direction is a longitudinal direction of the pressing pad 26. The pressing pad 26 is made of, for example, heat resistant resin, such as liquid crystal polymer (LCP).

The pressing pad 26 has the top surface (a side surface opposite to the fixing nip N) on which a plurality of sets of pair of right and left support protrusions 66 (for example, nine sets) are located at intervals in the front-rear direction. The pressing pad 26 has the center of the top surface of a lateral direction on which a plurality of protrusions 68 (for example, three) are located.

As illustrated in FIG. 3, a length of the pressing pad 26 in the front-rear direction is longer is than a length of the pressure roller 23 in the front-rear direction and is shorter than a length of the fixing belt 22 in the front-rear direction. The pressing pad 26 includes a pressing surface 69, and inclined surfaces 70 located on both front and rear sides of the pressing surface 69 (both outsides in the front-rear direction).

Figure 4:
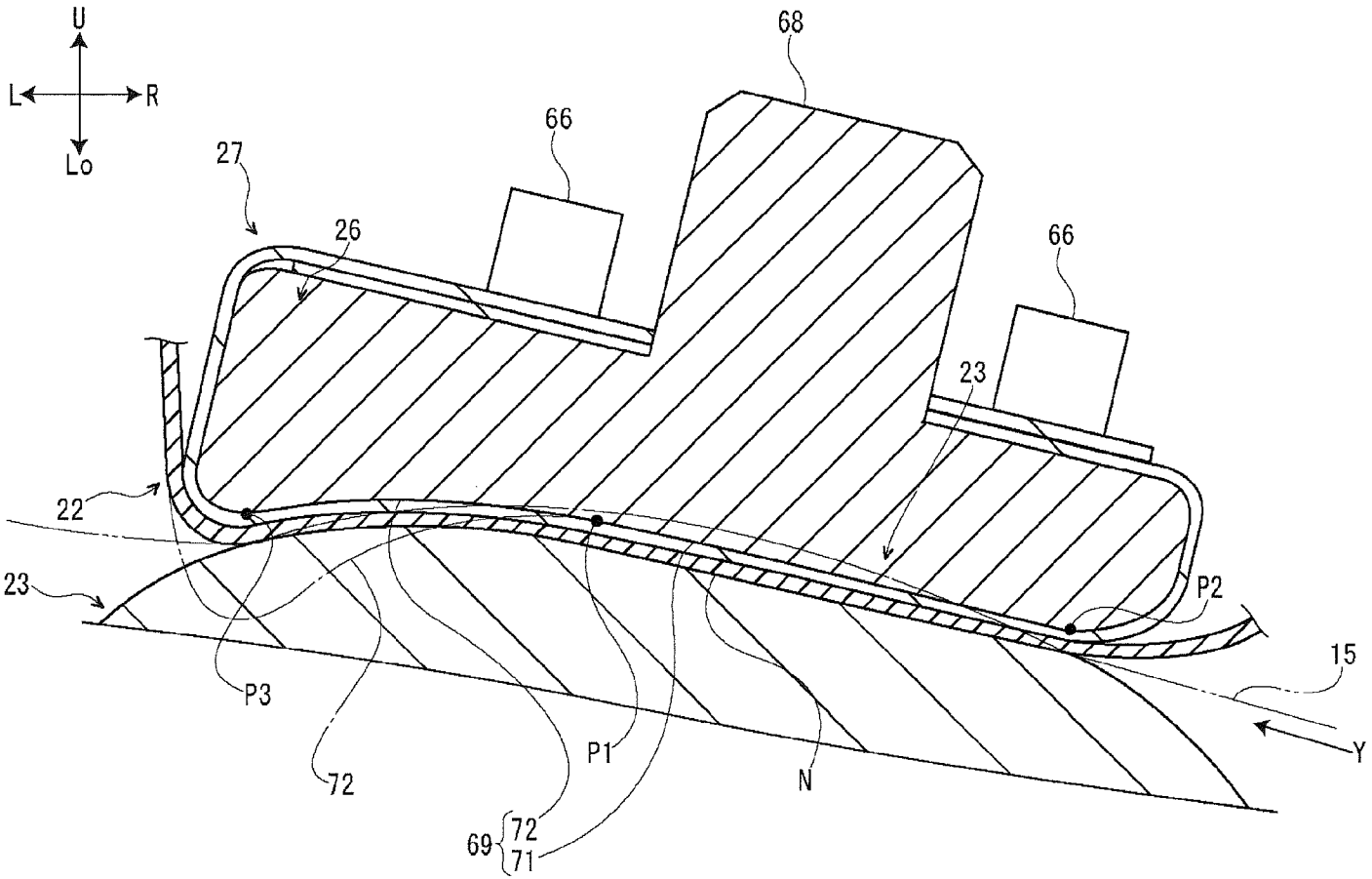
FIG. 4 illustrates a cross section of a fixing belt, a pressure roller, a pressing pad and a sheet member, which are included in the fixing device according to the one embodiment.

The pressing surface 69 of the pressing pad 26 presses the fixing belt 22 toward a lower side (a side of the pressure roller 23) via the sheet member 27. As illustrated in FIG. 4, the pressing surface 69 includes a plane surface portion 71 and a curved surface portion 72 located at a left side of the plane surface portion 71 (a downstream side in the conveyance direction of the paper sheet). In FIG. 4, a point P1 indicates a boundary between the plane surface portion 71 and the curved surface portion 72.

The pressing surface 69 of the pressing pad 26 has the plane surface portion 71 with a plane-surface shape located extending along the conveyance direction of the paper sheet viewing in the front-rear direction. The plane surface portion 71 has a right end portion P2 (corresponding to an end portion of an upstream side of the pressing surface 69 in the conveyance direction of the paper sheet). Viewing in the front-rear direction, the right end portion P2 does not overlap with the pressure roller 23 before the deformation in association with the formation of the fixing nip N (see an alternate long and short dash line illustrated in FIG. 4), that is, the right end portion P2 is displaced from the pressure roller 23. A length of the plane surface portion 71 in the conveyance direction of the paper sheet is longer than a length of the curved surface portion 72 in the conveyance direction of the paper sheet.

The pressing surface 69 of the pressing pad 26 has the curved surface portion 72 curved in an arc shape along the outer peripheral surface of the pressure roller 23 viewing in the front-rear direction. The curved surface portion 72 is curved in an upward convex similarly to an outer peripheral surface of an upper end portion of the pressure roller 23 (a portion at which the fixing belt 22 is sandwiched between the pressure roller 23 and the pressing surface 69 of the pressing pad 26). That is, the curved surface portion 72 and the outer peripheral surface of the upper end portion of the pressure roller 23 are curved in an identical direction. The curved surface portion 72 has a left end portion P3 (corresponding to an end portion of a downstream side of the pressing surface 69 in the conveyance direction of the paper sheet). Viewing in the front-rear direction, the left end portion P3 does not overlap with the pressure roller 23 before the deformation in association with the formation of the fixing nip N (see the alternate long and short dash line illustrated in FIG. 4), that is, the left end portion P3 is displaced from the pressure roller 23. The curved surface portion 72 has a curvature radius of 29.5 mm and is larger than a curvature radius of the outer peripheral surface of the pressure roller 23 before the deformation in association with the formation of the fixing nip N (15 mm).

Figure 5:
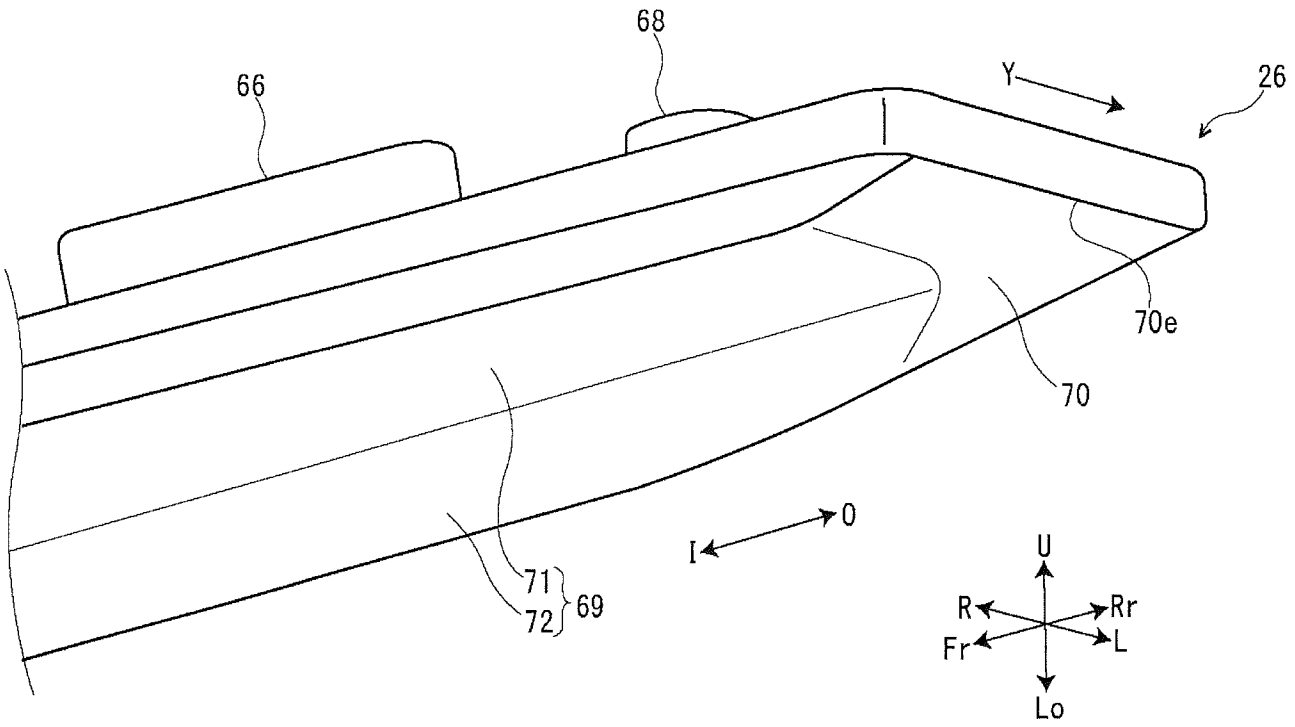
FIG. 5 obliquely illustrates a rear portion of the pressing pad in the fixing device according to the one embodiment.

As illustrated in FIG. 3, the pressing pad 26 includes the respective inclined surfaces 70 located outside in the front-rear direction with respect to the pressure roller 23. The respective inclined surfaces 70 do not contact an inner circumference surface of the fixing belt 22 and do not press the fixing belt 22 toward a lower side (the side of the pressure roller 23). The respective inclined surfaces 70 are inclined toward the outside of the front-rear direction and the upper side (the side spaced apart from the pressure roller 23). As illustrated in FIG. 5, the respective inclined surfaces 70 have edge portions 70*e* located outside in the front-rear direction. The edge portions 70*e* linearly extend along the conveyance direction of the paper sheet over the whole area from an end portion of an upstream side to an end portion of a downstream side in the conveyance direction of the paper sheet.

The sheet member 27 has a long shape in the front-rear direction. The sheet member 27 is made of, for example, fluorine-based resin such as PTFE, has a friction coefficient smaller than the pressing pad 26, and has high slidability. The sheet member 27 has a lower portion interposed between the inner circumference surface of the fixing belt 22 and the inferior surface of the pressing pad 26.

As illustrated in FIG. 2, the supporting member 28 has an approximately-quadrangular-prism shape (a rectangle-shaped cross section) and is long in the front-rear direction. The supporting member 28 has an upper portion inserted between the respective guide plate portions 60 of the reflecting member 25. The supporting member 28 is formed due to a weld of a combination of a first support plate 91 and a second support plate 92. The first support plate 91 and the second support plate 92 are formed into L-shaped sheet metals made of zinc plating steel plate (SECC) or similar steel plate, and are separately located one another.

The first support plate 91 of the supporting member 28 includes a first conveyance-direction-wall portion 93 and a first intersection-direction-wall portion 94. The first conveyance-direction-wall portion 93 extends along the conveyance direction of the paper sheet. The first intersection-direction-wall portion 94 is bent at an approximately right angle from a right end portion of the first conveyance-direction-wall portion 93 (an end portion of an upstream side in the conveyance direction of the paper sheet) and extends toward an upper side along a direction orthogonal to (intersecting with) the conveyance direction of the paper sheet (a side opposite to the fixing nip N). The first conveyance-direction-wall portion 93 has the inferior surface brought into close abutment on upper end portions of the respective support protrusions 66 of the pressing pad 26. Thus, the supporting member 28 supports the pressing pad 26 to regulate a deformation of the pressing pad 26. The first conveyance-direction-wall portion 93 has the center of the lateral direction on which a plurality of through holes 97 (for example, three) are located at intervals in the front-rear direction, and the respective through holes 97 are passed through by the respective protrusions 68 of the pressing pad 26. This causes the pressing pad 26 to be positioned with respect to the supporting member 28.

The second support plate 92 of the supporting member 28 includes a second conveyance-direction-wall portion 95 and a second intersection-direction-wall portion 96. The second conveyance-direction-wall portion 95 extends along the conveyance direction of the paper sheet. The second intersection-direction-wall portion 96 is bent at an approximately right angle from a left end portion of the second conveyance-direction-wall portion 95 (an end portion of a downstream side in the conveyance direction of the paper sheet) and extends toward an lower side along a direction orthogonal to (intersecting with) the conveyance direction of the paper sheet (a side of the fixing nip N). The second conveyance-direction-wall portion 95 has a right end portion secured to an upper end portion of the first intersection-direction-wall portion 94 of the first support plate 91. The second intersection-direction-wall portion 96 has a lower end portion secured to a left end portion of the first conveyance-direction-wall portion 93 of the first support plate 91.

The respective cover members 29 are made of, for example, metal such as SUS. As illustrated in FIG. 3, the respective cover members 29 are located such that positions of the front-rear direction of the respective cover members 29 are overlapped with the non-passing area R2 of the fixing belt 22.

As illustrated in FIGS. 2 and 3, the respective cover members 29 include a curving portion 100 and a pair of mounting portions 101. The pairs of the mounting portions 101 are bent from both right and left end portions of the curving portions 100 (both end portions in the conveyance direction of the paper sheet) and extend toward the lower side along the direction orthogonal to (intersecting with) the conveyance direction of the paper sheet (the side of the fixing nip N).

The respective cover members 29 include the curving portion 100, which is curved in an arc shape along the inner circumference surface of the fixing belt 22. The curving portions 100 are opposed to the inner circumference surface of the fixing belt 22 via an interval. The curving portions 100 have portions inside in the front-rear direction (also corresponding to portions inside in the front-rear direction of the whole of the respective cover members 29) on which a plurality of slits 102 (for example, three) are located at intervals in the circumferential direction. The respective slits 102 have elongated-hole shapes extending in the front-rear direction.

The respective mounting portions 101 of the respective cover members 29 have flat-plate shapes. The respective mounting portions 101 have portions outside in the front-rear direction of lower portions mounted on both right and left side surfaces of the supporting member 28 via screws 103. The respective mounting portions 101 have corner portions inside in the front-rear direction of the lower portions where depressed grooves 104 are located.

The respective cover members 29 have end portions outside in the front-rear direction on which cutout portions 105 are located across the curving portions 100 and the respective mounting portions 101. The cutout portions 105 are located such that positions of the front-rear direction of the cutout portions 105 are overlapped with the sealing portions 57 of the heater 24. The cutout portions 105 have end portions inside in the front-rear direction, and positions of the front-rear direction of the end portions inside in the front-rear direction match end portions inside in the front-rear direction of the sealing portions 57. The cutout portions 105 have end portions outside in the front-rear direction (also corresponding to portions outside in the front-rear direction of the whole of the respective cover members 29), which are located inside in the front-rear direction with respect to end portions outside in the front-rear direction of the sealing portions 57.

As illustrated in FIG. 3, the respective regulating members 30 are located outside in the front-rear direction with respect to the respective cover members 29. The respective regulating members 30 include regulating pieces 108 and ring pieces 109 mounted at the regulating pieces 108.

The regulating pieces 108 of the respective regulating members 30 include base portions 110, and inserted portions 111 projecting into surfaces inside in the front-rear direction of the base portions 110. The regulating pieces 108 include guide holes 112, through which the base portions 110 and the inserted portions 111 pass, and the guide holes 112 are located along the front-rear direction. The heater 24 and the supporting member 28 pass through these guide holes 112. The inserted portions 111 are curved along outer peripheries of the guide holes 112 and have arc shapes (C shapes facing downward). The inserted portions 111 are inserted into both the front and rear end portions of the fixing belt 22. This regulates the shape of the fixing belt 22 (prevents a deformation of the fixing belt 22).

The ring pieces 109 of the regulating members 30 each have an annular shape. The ring pieces 109 are mounted at outer peripheries of the inserted portions 111 of the regulating pieces 108. The ring pieces 109 are located outside in the front-rear direction of both the front and rear end portions of the fixing belt 22 to regulate a meandering of the fixing belt 22 (a movement outside in the front-rear direction).

When the fixing device 18 with the above-described configuration fixes the toner image on the paper sheet, the driving source 50 rotates the pressure roller 23 (see an arrow B illustrated in FIG. 2). Thus, the rotation of the pressure roller 23 drives the fixing belt 22 in pressure contact with the pressure roller 23 to rotate in a direction opposite to the pressure roller 23 (see an arrow C illustrated in FIG. 2). Then, the rotation of the fixing belt 22 slides the fixing belt 22 with respect to the sheet member 27.

When the toner image is fixed on the paper sheet, the heater 24 is energized. Thus, when the heater 24 is energized, the heater 24 radiates the radiation heat from the filament 54. The heater 24 directly irradiates the inner circumference surface of the fixing belt 22 with a part of the radiation heat radiated from the filament 54, and then the radiation heat is absorbed. Another part of the radiation heat radiated from the filament 54 of the heater 24 is reflected by the top surface of the reflecting plate portion 59 of the reflecting member 25 toward the inner circumference surface of the fixing belt 22, and then the inner circumference surface of the fixing belt 22 absorbs the radiation heat. The above-described operations cause the heater 24 to heat the fixing belt 22. In this state, when the paper sheet passes through the fixing nip N, the toner image is heated and melted, thus fixing the toner image on the paper sheet.

In the fixing device 18 with the above-described configuration, when the curvature radius of the curved surface portion 72 located on the pressing surface 69 of the pressing pad 26 is smaller than the curvature radius of the outer peripheral surface of the pressure roller 23 before the deformation in association with the formation of the fixing nip N, the curved surface portion 72 consequently has a shape such that the curved surface portion 72 bites into the side of the pressure roller 23 (see the alternate long and short dash line illustrated in FIG. 4). This causes rotating torque of the fixing belt 22 to increase, thus possibly leading to a rotation failure of the fixing belt 22.

Thus in the embodiment, the curved surface portion 72 has a larger curvature radius than the curvature radius of the outer peripheral surface of the pressure roller 23 before the deformation in association with the formation of the fixing nip N, so as to prevent the curved surface portion 72 from having a shape to bite into the side of the pressure roller 23. This reduces the increase of the rotating torque of the fixing belt 22, thus ensuring the reduced rotation failure of the fixing belt 22.

Especially in the embodiment, the curved surface portion 72 has the left end portion P3 (corresponding to the end portion of the downstream side of the pressing surface 69 in the conveyance direction of the paper sheet). Viewing in the front-rear direction, the left end portion P3 does not overlap with the pressure roller 23 before the deformation in association with the formation of the fixing nip N (see the alternate long and short dash line illustrated in FIG. 4), that is, the left end portion P3 is displaced from the pressure roller 23. This further reliably ensures the reduced rotation failure of the fixing belt 22.

The curved surface portion 72, which is curved along the outer peripheral surface of the pressure roller 23, is located on the pressing surface 69 of the pressing pad 26, thus ensuring a sufficient width for the fixing nip N. This causes the toner image to be reliably fixed on the paper sheet in the fixing nip N without keeping the fixing nip N at a high temperature, thus ensuring the improved energy-saving of the fixing device 18.

Further, the plane surface portion 71, which extends along the conveyance direction of the paper sheet, is located on the pressing surface 69 of the pressing pad 26, thus ensuring a sufficiently-separated space between the fixing belt 22 and the pressure roller 23 in an upstream side of the fixing nip N in the conveyance direction of the paper sheet. This causes the paper sheet to be reliably conveyed to the fixing nip N, thus ensuring the reduced occurrence of the jam.

Especially in the embodiment, the plane surface portion 71 has the right end portion P2 (corresponding to the end portion of the upstream side of the pressing surface 69 in the conveyance direction of the paper sheet). Viewing in the front-rear direction, the right end portion P2 does not overlap with the pressure roller 23 before the deformation in association with the formation of the fixing nip N (see the alternate long and short dash line illustrated in FIG. 4), that is, the right end portion P2 is displaced from the pressure roller 23. The employment of such configuration further reliably ensures the conveyance of the paper sheet to the fixing nip N.

Further, the length of the plane surface portion 71 in the conveyance direction of the paper sheet is longer than the length of the curved surface portion 72 in the conveyance direction of the paper sheet. The employment of such configuration facilitates the further-separated space between the fixing belt 22 and the pressure roller 23 in the upstream side of the fixing nip N in the conveyance direction of the paper sheet. This causes the paper sheet to be further reliably conveyed to the fixing nip N, further reliably ensuring the reduced occurrence of the jam.

When the length of the pressing pad 26 in the front-rear direction is identical to the length of the pressure roller 23 in the front-rear direction, the fixing belt 22 may be bent around a portion between end portions outside in the front-rear direction of the pressing pad 26 and end portions outside in the front-rear direction of the pressure roller 23 as a pivot point, which leads to a fatigue failure of the fixing belt 22. Thus in the embodiment, the length of the pressing pad 26 in the front-rear direction is longer than the length of the pressure roller 23 in the front-rear direction. The employment of such configuration ensures the reduced bending of the above-described fixing belt 22.

However, as described above, if the length of the pressing pad 26 in the front-rear direction is longer than the length of the pressure roller 23 in the front-rear direction, this may cause a large stress on the fixing belt 22 from the pressing pad 26 in an area outside in the front-rear direction with respect to the pressure roller 23, which leads to the fatigue failure of the fixing belt 22. Especially, an end surface of the fixing belt 22 may easily lead to the fatigue failure due to, for example, a burr formed when the fixing belt 22 is formed, and a variation in a polish state even when a small stress is applied on the end surface of the fixing belt 22.

Thus in the embodiment, the inclined surfaces 70, which are inclined toward the outside of the front-rear direction and the upper side (the side spaced apart from the pressure roller 23), are located outside in the front-rear direction of the pressing surface 69 of the pressing pad 26. The employment of such configuration ensures the reduced stress to be applied on the fixing belt 22 from the pressing pad 26 in the area outside in the front-rear direction with respect to the pressure roller 23, thus ensuring the fixing belt 22 with a shape similar to a true circle as much as possible. This ensures the reduced fatigue failure of the fixing belt 22.

The edge portions 70*e*, which are located outside in the front-rear direction of the inclined surfaces 70, linearly extend along the conveyance direction of the paper sheet. The employment of such configuration causes the edge portions 70*e*, which are located outside in the front-rear direction of the inclined surfaces 70, to be less likely to contact the inner circumference surface of the fixing belt 22 compared with a case where the edge portions 70*e*, which are located outside in the front-rear direction of the inclined surfaces 70, are curved. This ensures the reduced abrasion of the fixing belt 22.

While in the embodiment the above has described a case where the sheet member 27 made of fluorine-based fiber material is wound around the pressing pad 26, in another embodiment, a fluorine-based coating may be performed on the pressing pad 26.

While in the embodiment the above has described a case where the heater 24 is constituted of the halogen heater, in another embodiment, for example, a ceramic heater may be employed as the heater 24.

While in the embodiment the above has described a case where the configuration of the disclosure is applied to the printer 1, in another embodiment, the configuration of the disclosure is applicable to another image forming apparatus, such as a copier, a facsimile, a multi-functional peripheral, and similar apparatus.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device, comprising:

a fixing belt rotatable around a rotation axis;

a pressure member in pressure contact with the fixing belt to form a fixing nip, the pressure member being rotatable; and a pressing member including a pressing surface that presses the fixing belt toward the pressure member, wherein the pressing surface includes:

a plane surface portion extending along a conveyance direction of a recording medium; and a curved surface portion located at a downstream side of the plane surface portion in the conveyance direction of the recording medium, the curved surface portion being curved along an outer peripheral surface of the pressure member;

wherein the curved surface portion has a curvature radius larger than a curvature radius of the outer peripheral surface of the pressure member before a deformation in association with a formation of the fixing nip, the pressing member has a length in a direction of the rotation axis longer than a length of the pressure member in the direction of the rotation axis, the pressing member being shorter than a length of the fixing belt in the direction of the rotation axis, and the pressing member having inclined surfaces outside of the pressing surface in the direction of the rotation axis, the inclined surfaces being inclined in a direction away from the pressure member and extending from both ends of the pressure member in the direction of the rotation axis.

2. The fixing device according to claim 1, wherein the pressing surface has, in the conveyance direction of the recording medium, end portions of an upstream side and a downstream side displaced from, viewing in a direction of the rotation axis, the pressure member before the deformation in association with the formation of the fixing nip.

3. The fixing device according to claim 1, wherein the inclined surfaces have outer edge portions in the direction of the rotation axis, the outer edge portions linearly extending along the conveyance direction of the recording medium.

4. The fixing device according to claim 1, wherein a length of the plane surface portion in the conveyance direction of the recording medium is longer than a length of the curved surface portion in the conveyance direction of the recording medium.

5. An image forming apparatus, comprising the fixing device according to claim 1.

* * * * *